US005531205A

United States Patent [19]

Cook et al.

[11] Patent Number: 5,531,205

[45] Date of Patent: Jul. 2, 1996

[54] ROTARY DIESEL ELECTRIC EGR VALVE

[75] Inventors: John E. Cook; Scott E. W. Hussey, both of Chatham, Canada

[73] Assignee: Siemens Electric Limited, Ontario, Canada

[21] Appl. No.: 414,454

[22] Filed: Mar. 31, 1995

[51] Int. Cl.[6] ..... F02M 25/07

[52] U.S. Cl. ..... 123/568; 123/569; 123/571; 251/306

[58] Field of Search ..... 123/568, 569, 123/571; 251/305, 306, 307

[56] References Cited

U.S. PATENT DOCUMENTS

| | | | |
|---|---|---|---|
| 3,882,837 | 5/1975 | Horie et al. | 123/568 |
| 3,916,857 | 11/1975 | Naito et al. | 123/569 |
| 4,020,809 | 5/1977 | Kern et al. | 123/569 |
| 4,290,615 | 9/1981 | Etcheverry | 251/306 |
| 4,475,524 | 10/1984 | Eckert et al. | 123/568 |
| 4,770,393 | 9/1988 | Hubertson | 251/306 |
| 4,836,500 | 6/1989 | Pupillo et al. | 251/306 |
| 4,924,840 | 5/1990 | Wade | 123/571 |
| 5,388,806 | 2/1995 | Kusmer et al. | 251/306 |

*Primary Examiner*—Willis R. Wolfe

[57] ABSTRACT

An EGR valve is well-suited for use in a diesel engine by employing a butterfly-type valve operated by a torque motor. Sealing of the butterfly blade to the wall of the passage through the valve body utilizes a sealing ring that is mounted in a groove of the passage wall. The blade and the sealing ring are self-aligned at assembly, and the groove is cooperatively defined by two body segments that are fitted axially together to capture the sealing ring. Two additional rings are used between the sealing ring and the sides of the groove. In certain embodiments, the axis of the passage in the vicinity of the groove is straight; in others, it has a 45 degree offset so that portions of the axis to opposite sides of the groove are non-collinear.

17 Claims, 3 Drawing Sheets

ROTARY DIESEL ELECTRIC EGR VALVE

FIELD OF THE INVENTION

This invention relates generally to exhaust gas recirculation (EGR) for internal combustion engines, and is particularly directed to an EGR valve that is especially, although not exclusively, useful for controlling the recirculation of engine exhaust gas in a diesel engine.

BACKGROUND AND SUMMARY OF THE INVENTION

Controlled engine exhaust gas recirculation is a commonly used technique for reducing oxides of nitrogen in products of combustion that are exhausted from an internal combustion engine to atmosphere. A typical EGR system comprises an EGR valve that is controlled in accordance with engine operating conditions to regulate the amount of engine exhaust gas that is recirculated to the induction fuel-air flow entering the engine for combustion so as to limit the combustion temperature and hence reduce the formation of oxides of nitrogen.

Pintle-type EGR valves are commonly used, but the presence of the pintle within the valve passage restricts the area of the passage that is available to conduct the flow, and hence for a given flow, the passage diameter must be large enough to take the presence of the pintle into account. A butterfly-type valve offers certain advantages over a pintle-type, especially when applied to a diesel engine.

Various operating conditions that an EGR valve may encounter in a typical diesel engine include conditions where high flow rates must be conducted with minimal restriction and where large pressure differentials may appear across the EGR valve. A butterfly-type valve is capable of providing a low flow restriction operating condition, and it is less sensitive to pressure differentials acting across it because of its inherent force balancing character. However in order to take full advantage of a butterfly-type valve in a diesel engine application while satisfying all required operating conditions, a certain range of rotary motion is required. Ordinarily, a butterfly-type valve must be rotated substantially 90 degrees between full open and full closed positions in order to take advantage of its desirable characteristics. Such motion can be delivered to the valve by a linear actuator and linkage system, but the linkage system will typically add complexity and cost, and may even be disadvantageous in certain applications.

The present invention relates to new and unique embodiments of EGR valve that take advantage of the desirable attributes of a butterfly-type valve without the necessity of using a linkage system that provides 90 degrees of rotation for the valve. This makes the inventive EGR valve especially well-suited for use with a diesel engine, although broader principles of the invention are not necessarily limited to such specific engine usage.

An EGR valve must also be capable of withstanding the harsh operating environment where it is exposed to wide temperature extremes and corrosive elements. Since governmental laws and regulations are typically applicable to an automotive vehicle's engine EGR system, the EGR valve must also be capable of performing satisfactorily over the duration for which such laws and regulations are applicable to the vehicle's engine exhaust emission control system.

Since sealing of the butterfly-valve relative to the wall of the passage through the valve body when the valve is fully closed may at times be quite important, a sealing means may be required. Typically, such sealing means is disposed on the butterfly itself.

The present invention recognizes certain disadvantages of incorporating a sealing means on the butterfly, and instead comprises a sealing ring mounted in a groove in the wall of the passage. By placing the sealing ring on the wall of the passage, instead of on the butterfly, the mass of the butterfly can be minimized, thereby making for improved responsiveness of the butterfly to commanded changes in position. Certain machining operations on the butterfly are also avoided.

But mounting the sealing ring in a groove in the wall must be accomplished in such a way that the complications of mounting it on the butterfly are not merely transferred to mounting it on the valve body; especially to be avoided are complex machining and assembly operations.

In the inventive EGR valve, the groove is cooperatively defined by two axially end-to-end joined segments of the valve body for advantageous assembly of the various component parts. The sealing ring and butterfly are self-aligned during the assembly process, and the assembly process itself consists simply of fitting the two end-to-end segments of the valve body together to capture the sealing ring, and two associated parts, and concurrently ensure the alignment of the butterfly to the sealing ring.

The preferred forms of the inventive valve use aluminum or aluminum alloy for the valve body segments, and to minimize the possibility of galvanic action between the steel sealing ring and the aluminum valve body, respective stainless steel elements are placed to each side of the groove between the sealing ring and the valve body. One of these elements is resiliently sprung so that resilient axial force is applied to the sealing ring.

A rotary torque motor is also advantageously employed in the inventive valve in a unique geometric relationship, and the two segment construction of the valve body facilitates the incorporation of this feature into the inventive valve. With 45 degrees of rotation of its shaft, the torque motor accomplishes positioning of the butterfly from a fully closed position to a position of minimum restriction of the flow passage.

Further features, advantages, and benefits of the invention will be seen in the ensuing description and claims that are accompanied by drawings. The drawings disclose a presently preferred embodiment of the invention according to the best mode contemplated at this time for carrying out the invention.

DESCRIPTION OF THE PREFERRED EMBODIMENT

Figure 1:
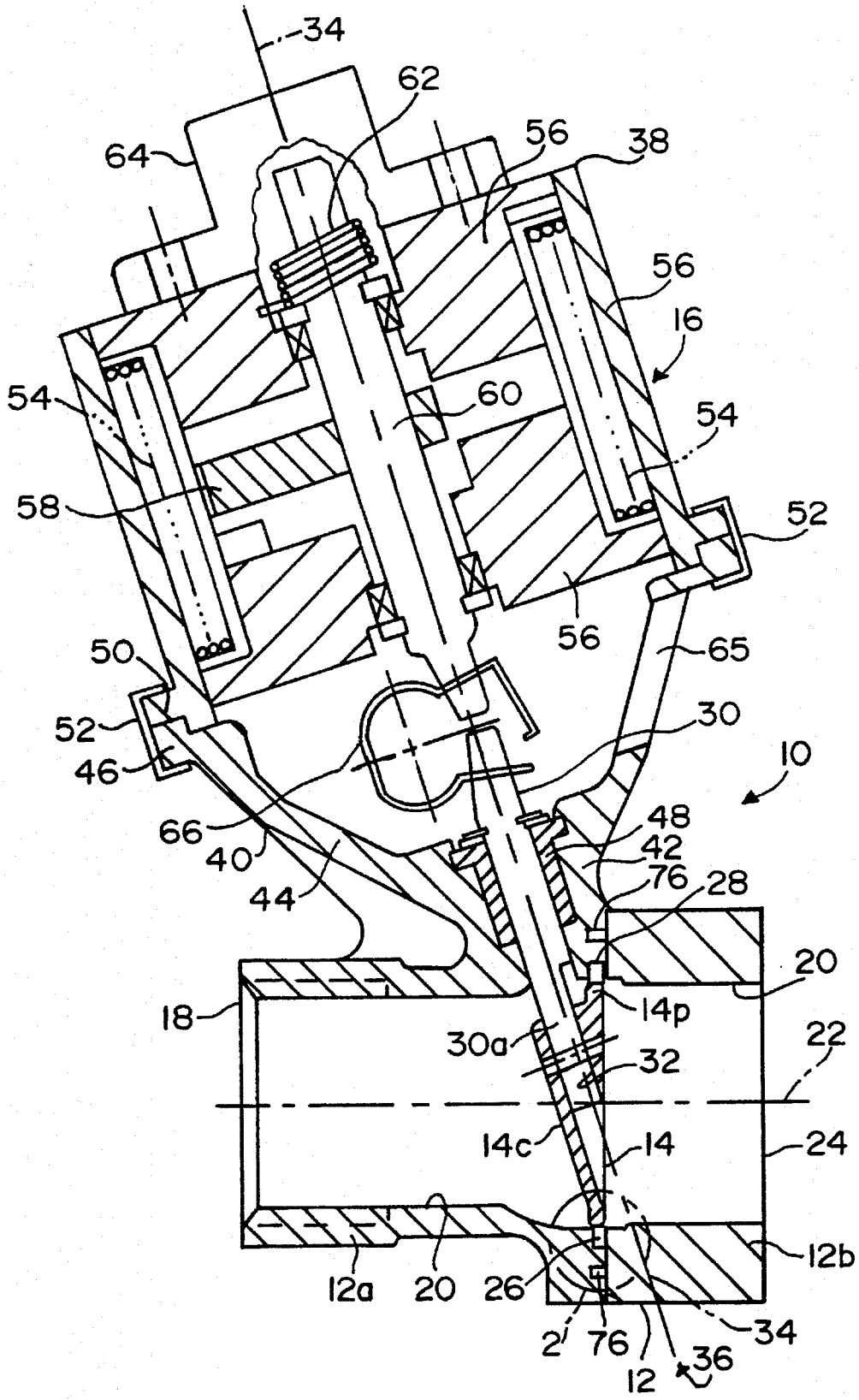
FIG. 1 is a longitudinal cross section in elevation through a first embodiment of EGR valve embodying principles of the invention.
Figure 2:
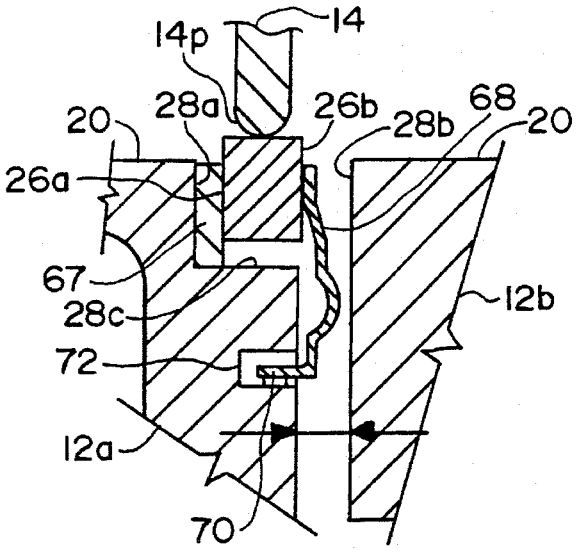
FIG. 2 is an enlarged view in circle 2 of FIG. 1.

FIGS. 1 and 2 show a first embodiment of inventive EGR valve 10 in closed position. Valve 10 comprises: a valve body 12 having body segments 12*a*, 12*b* joined together; a butterfly 14; and an actuating mechanism, 16 generally, for operating butterfly 14.

Body 12 comprises an inlet 18 at which engine exhaust gas to be recirculated enters body segment 12*a*, a walled passage 20 that has its own axis 22 and that extends through body 12 for conveying engine exhaust gas that has entered inlet 18, and an outlet 24 at which engine exhaust gas that has passed through said passage 20 exits body segment 12*b*. FIGS. 1 and 2 show butterfly 14 in closed operating position so that engine exhaust gas is blocked from being recirculated through EGR valve 10. The wall of passage 20 is circular about axis 22, and axis 22 is straight so that the respective sections of passage 20 in the respective body sections 12*a*, 12*b* are co-axial. Butterfly 14 has a circular perimeter 14*p* that bounds a central region 14*c*. A circular sealing ring 26 is mounted in a groove 28 in the wall of passage 20, and FIGS. 1 and 2 show perimeter 14*p* in concentric sealing relation to sealing ring 26.

Actuating mechanism 16 comprises a shaft 30 to which central region 14*c* of butterfly 14 is affixed. While perimeter 14*p* is co-planar and circular for sealing with sealing ring 26 in the closed position shown, central region 14*c* comprises a shape that defines a non-circular hole 32 into which a matching non-circular distal end 30*a* of shaft 30 is inserted. Butterfly 14 is attached to shaft end 30*a* such that rotary positioning of shaft 30 about its own axis 34 will operate butterfly 14 and such that exhaust gas will not leak through the attachment. Axis 34 substantially intersects axis 22, but is skewed at substantially about a 70 degree angle relative to the portion of axis 22 extending through body segment 12*a*, and at substantially about a 20 degree angle relative to the plane of perimeter 14*p* when the butterfly is closed as shown. Since ring 26 is substantially perpendicular to axis 22, it, like the closed butterfly 14, lies at substantially about a 20 degree angle to axis 34.

Figure 3:
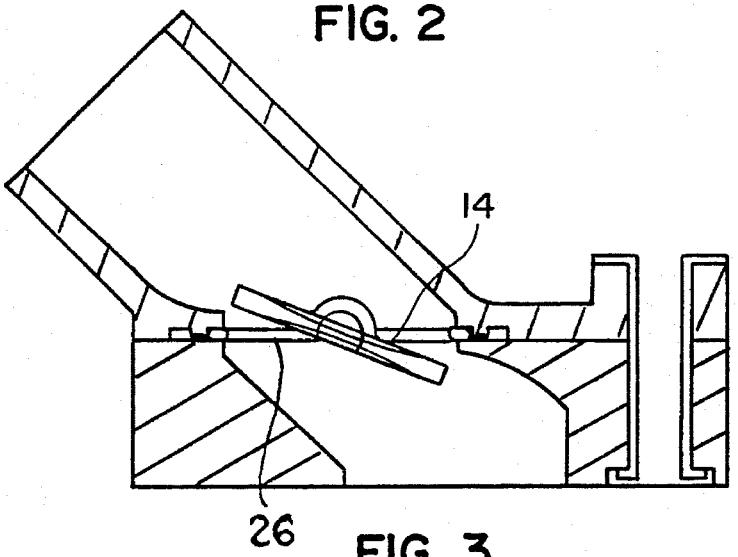
FIG. 3 is a downwardly projected plan view of a portion of FIG. 1 showing a different operative position.
Figure 4:
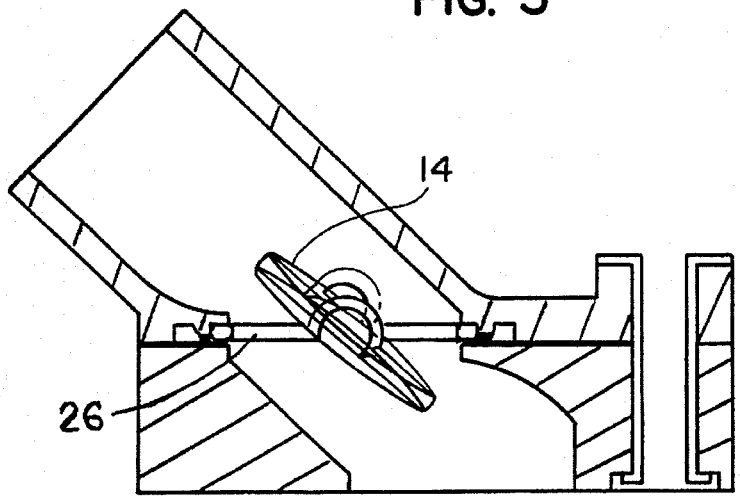
FIG. 4 is a downwardly projected plan view similar to FIG. 3 showing fully open and fully closed operative positions.

When shaft 30 executes rotary motion in the clockwise sense as viewed in the direction of arrow 36 in FIG. 1, butterfly 14 will open. FIG. 3 shows butterfly 14 in a partially open position, and FIG. 4, in maximally open position. In maximally open position, the plane of perimeter 14*p* is substantially parallel with axis 22, and the butterfly imposes substantially minimal flow restriction. Compound motion of butterfly 14 from the FIG. 1 closed position (i.e., maximal flow restriction where it obturates passage 20), to the FIG. 3 position of minimal flow restriction occurs in response to substantially 45 degrees of rotation of shaft 30 about axis 34.

An electromechanical actuator that is capable of producing such a range of motion with the requisite torque, speed, and accuracy is a rotary torque motor. Actuating mechanism 16 comprises such an actuator 38. The exterior of body segment 12*a* is provided with an integral mounting 40 that serves both to journal shaft 30 and to mount torque motor 38. Mount 40 comprises a base 42 disposed immediately proximate the joining of segments 12*a* and 12*b* and a generally frustoconical wall 44 that flares outwardly from base 42 coaxial with axis 34 to terminate in a circular rim 46. A shouldered through-hole extends through base 42 and serves to retain in place a bushing 48 via which shaft 30 is journaled for rotary motion about axis 34. From its attachment to butterfly 14, shaft 30 extends through bushing 48 and terminates inside wall 44. The bushing and the passage of the shaft through it are fluid tight so that exhaust gas cannot pass through to the interior of wall 44.

Torque motor 38 comprises a housing having a rim 50 that fits to rim 46 of mount 40. A retaining ring 52 holds the torque motor securely on rim 46. The torque motor comprises the usual coil 54 and associated stator structure 56 for positioning the usual armature 58 about the torque motor's axis, which is coaxial with axis 34, and will therefore be similarly referenced. Armature 58 includes a shaft 60 that is axially retained relative to stator structure 56 and journaled for rotary positioning about axis 34. A torsion spring 62 is disposed proximate the outer end of shaft 60 to act between stator structure 56 and shaft 60 for resiliently biasing shaft 60 about axis 34 to a position corresponding to butterfly 14 being in the closed position of FIG. 1. As electric current is increasingly applied to coil 54 (via electric terminals that do not appear in the FIGS.), an increasing electromagnetic torque is exerted on armature 58 causing the armature, and hence shaft 60, to increasingly turn about axis 34. This increasing torque is resisted by the increasing counter-torque of spring 62, with the result being that the armature finally stops at a position about axis 34 determined by the current applied to coil 54. Thus, the rotary position of shaft 60 is a function of the electric current supplied to coil 54, and this current is determined by various operating conditions as detected by the engine control system, typically including an engine management computer processing data from relevant sensors in accordance with one or more appropriate algorithms. For providing torque motor position feedback to the engine management computer, a position sensor 64 is mounted at the far end of the torque motor housing and operatively coupled with the far end of shaft 60.

Wall 44 comprises an opening 65 providing for a clip 66 to be installed to couple the rotary motion of shaft 60 to shaft 30 so that the torque motor exercises complete control of the positioning of butterfly 14. The connections of the clip to the respective shafts are quite precise so that at most, any lost motion is negligible and insignificant.

Another feature of the invention concerns the manner of mounting sealing ring 26 on the wall of passage 20. The respective axially extending body segments 12*a*, 12*b* are disposed axially end-to-end and cooperatively define the radially inwardly open groove 28 within which said sealing ring 26 is disposed. Groove 28 comprises opposed axially facing wall surfaces 28*a*, 28*b* in segments 12*a*, 12*b* respectively. The groove also has a radially inwardly facing wall surface 28*c* that lies on a circular diameter slightly greater than that of the outside diameter of sealing ring 26. That, plus the presence of two circular rings 67, 68, provide for sealing ring 26 to position itself within groove 28 during the process of assembling the component parts of EGR valve 10 together. Ring 67 is disposed between wall surface 28*a* and the respective axially facing end surface 26*a* of sealing ring 26, while ring 68 is disposed between wall surface 28*b* and the respective axially facing end surface 26*b* of the sealing ring. Since body segments 12*a*, 12*b* are preferably aluminum or an aluminum alloy, rings 67, 68 are stainless steel to reduce the possibility of galvanic action between the steel sealing ring 26 and the aluminum valve body 12.

Ring 68 is shaped with an axially extending flange 70 that locates the ring in a circular groove 72 in body segment 12*a* that is axially open toward body segment 12*b* and coaxial with axis 22. Groove 72 is also spaced radially outwardly of groove 28 relative to axis 22. Ring 28 extends radially inwardly from flange 70 to radially overlap end surface 26*b* of sealing ring 26 and comprises resiliency for resiliently urging the opposite sealing ring surface 26*a* against ring 67 and the latter in turn against groove surface 28*a*.

As the two body segments 12*a*, 12*b* are moved together end-to-end for assembly, the sealing ring and butterfly are self-aligned. Further radially outwardly of groove 72 is a seal 76 for making the joint fluid tight so that exhaust gas will not leak out between the two assembled body segments 12*a*, 12*b*.

Figure 5:
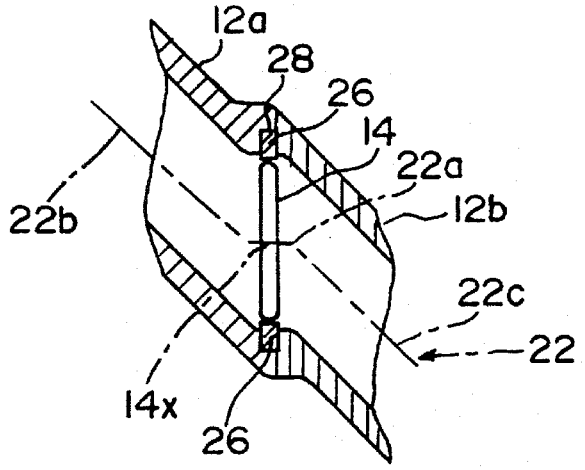
FIG. 5 is a longitudinal cross section through a second embodiment, with certain detail removed for illustrative purposes only.
Figure 6:
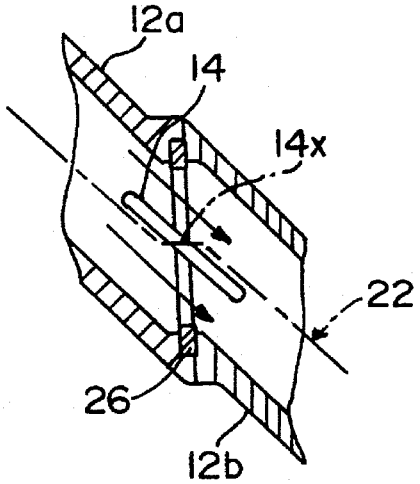
FIG. 6 is a view similar to FIG. 5, but showing a different operative position.

FIGS. 5 and 6 disclose an embodiment in which a portion of axis 22 that extends axially coextensive with and immediately contiguous groove 28 both toward inlet 18 and toward outlet 24 comprises an offset 22*a* that causes respective segments 22*b*, 22*c* of axis 22 that are respectively toward the inlet and toward the outlet relative to the groove to be non-collinear. Sealing ring 26 and groove 28 are disposed in an offset section whose axis portion 22*a* is substantially at 45 degrees to axis portions 22*b*, 22*c*. FIG. 5 shows the closed position, and FIG. 6 the open position. It can be seen that the circular butterfly blade 14 executes 45 degrees of rotation about an axis 14*x* that lies on a diameter of the blade. Torque motor 38 can have its shaft coaxial with the diameter about which the blade rotates and directly coupled to the blade with the sealing ring 26, groove 28, and the joint between the two body segments 12*a*, 12*b* being suitably modified to accommodate passage of the connection from the torque motor to the blade without introducing exhaust gas leakage. The sealing ring is mounted in similar fashion to that described earlier for the first embodiment although details are not specifically shown in FIGS. 5 and 6.

Figure 7:
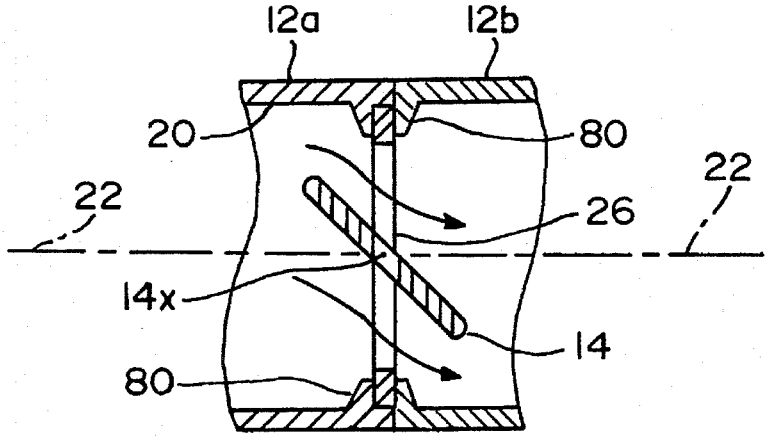
FIG. 7 is longitudinal cross section through a third embodiment, with certain detail removed for illustrative purposes only.

FIG. 7 shows a third embodiment where axis 22 remains straight, but groove 28 is disposed in a circular ridge 80 that extends around the inside of passage 20. Like the previous two embodiments, FIG. 7 utilizes two body segments 12*a*, 12*b* joined end-to-end and a mounting of the sealing ring 26 within groove 28 that provides for self-alignment of the butterfly blade to the sealing ring during assembly. The torque motor is used to impart the same 45 degrees of rotation to the butterfly in a manner analogous to that just described in connection with FIGS. 5 and 6.

While a presently preferred embodiment of the invention has been illustrated and described, it should be appreciated that principles of the invention may be embodied in other constructions that fall within the scope of the following claims.

What is claimed is:

1. An exhaust gas recirculation (EGR) valve for an internal combustion engine comprising a body, an inlet at which engine exhaust gas to be recirculated enters said body, a walled passage that has its own axis and that extends through said body for conveying engine exhaust gas that has entered said inlet, an outlet at which engine exhaust gas that has passed through said walled passage exits said body, a valve blade that is disposed within said walled passage and is selectively positionable within said walled passage for selectively restricting flow through said walled passage, actuating means disposed exterior of said walled passage, an actuating shaft operatively coupling said actuating means with said valve blade for selectively positioning said valve blade between a closed position wherein said valve blade is sealed relative to said walled passage and a number of increasingly open positions, and a sealing ring mounted on, and extending peripherally around, said walled passage, said sealing ring having its own axis and comprising opposite end surfaces facing in opposite axial directions relative to said sealing ring's axis and a radially inward surface extending between said opposite end surfaces, said valve body comprising respective body segments disposed end-to-end axially along said walled passage's axis and cooperatively defining a groove that is radially inwardly open relative to said walled passage's axis and within which said sealing ring is disposed, and means providing for said sealing ring to position itself within said groove during the process of assembling the EGR valve such that said radially inward surface of said sealing ring concentrically seals to an outer perimeter of said valve blade when said valve blade is in closed position, said groove comprising confronting wall surfaces that are axially spaced apart along said walled passage's axis, and said means providing for said sealing ring to position itself within said groove during the process of assembling the EGR valve including separate individual elements in association with said groove, each separate individual element being disposed between a respective one of said confronting wall surfaces of said groove and a respective end surface of said sealing ring, one of said separate individual elements comprising a resilient portion for resiliently urging said sealing ring against the other of said separate individual elements, and including a sealing means disposed radially outwardly of said groove relative to said walled passage's axis for sealing between said body segments so that engine exhaust gas does not leak out of said walled passage between said body segments.

2. An EGR valve as set forth in claim 1 in which said body segments are aluminum or an aluminum alloy, and said separate individual elements are stainless steel.

3. An EGR valve as set forth in claim 1 in which a portion of said walled passage's axis that extends axially coextensive with and immediately contiguous said groove both toward said inlet and toward said outlet is straight and said sealing ring's axis is disposed substantially coaxial with said portion of said walled passage's axis.

4. An exhaust gas recirculation (EGR) valve for an internal combustion engine comprising a body, an inlet at which engine exhaust gas to be recirculated enters said body, a walled passage that has its own axis and that extends through said body for conveying engine exhaust gas that has entered said inlet, an outlet at which engine exhaust gas that has passed through said walled passage exits said body, a valve blade that is disposed within said walled passage and is selectively positionable within said walled passage for selectively restricting flow through said walled passage, actuating means disposed exterior of said walled passage, an actuating shaft operatively coupling said actuating means with said valve blade for selectively positioning said valve blade between a closed position wherein said valve blade is sealed relative to said walled passage and a number of increasingly open positions, and a sealing ring mounted on, and extending peripherally around, said walled passage, said sealing ring having its own axis and comprising opposite end surfaces facing in opposite axial directions relative to said sealing ring's axis and a radially inward surface extending between said opposite end surfaces, said valve body comprising respective body segments disposed end-to-end axially along said walled passage's axis and cooperatively defining a groove that is radially inwardly open relative to said walled passage's axis and within which said sealing ring is disposed, and means providing for said sealing ring to position itself within said groove during the process of assembling the EGR valve such that said radially inward surface of said sealing ring concentrically seals to an outer perimeter of said valve blade when said valve blade is in closed position, and in which a portion of said walled passage's axis that extends axially coextensive with and immediately contiguous said groove both toward said inlet and toward said outlet comprises an offset that causes respective segments of said walled passage's axis that are respectively toward said inlet and toward said outlet relative to said groove to be non-colinear, and said sealing ring is disposed substantially at 45 degrees to said respective segments of said walled passage's axis.

5. An exhaust gas recirculation (EGR) valve for an internal combustion engine comprising a body, an inlet at which engine exhaust gas to be recirculated enters said body, a walled passage that has its own axis and that extends through said body for conveying engine exhaust gas that has entered said inlet, an outlet at which engine exhaust gas that has passed through said walled passage exits said body, a valve blade that is disposed within said Walled passage and is selectively positionable within said walled passage for selectively restricting flow through said walled passage, actuating means, an actuating shaft operatively coupling said actuating means with said valve blade for selectively positioning said valve blade by means of said actuating means between a maximally open position wherein said valve blade minimally restricts said walled passage and a closed position wherein said valve blade is sealed relative to said walled passage by a sealing ring mounted on, and extending peripherally around, said walled passage, said sealing ring having an inside perimeter against which an outside perimeter of said valve blade seals when in closed position, and wherein said actuating means causes said actuating shaft to execute substantially 45 degrees of rotary motion for operating said valve blade between maximally open position, where said outside perimeter of said valve blade occupies a plane that is substantially parallel with a general direction of flow parallel to said axis at the location of said blade along said walled passage when said blade is in maximally open position, and closed position where said sealing ring's inside perimeter seals against said outside perimeter of said valve blade.

6. An exhaust gas recirculation (EGR) valve for an internal combustion engine comprising a body, an inlet at which engine exhaust gas to be recirculated enters said body, a walled passage that has its own axis and that extends through said body for conveying engine exhaust gas that has entered said inlet, an outlet at which engine exhaust gas that has passed through said walled passage exits said body, a valve blade that is disposed within said walled passage and is selectively positionable within said walled passage for selectively restricting flow through said walled passage, actuating means, an actuating shaft operatively coupling said actuating means with said valve blade for selectively positioning said valve blade by means of said actuating means between a maximally open position wherein said valve blade minimally restricts said walled passage and a closed position wherein said valve blade is sealed relative to said walled passage, sealing means for sealing said valve blade relative to said walled passage when said valve blade is in closed position comprising a sealing ring mounted on, and extending peripherally around, said walled passage, said sealing ring having an inside perimeter against which an outside perimeter of said valve blade seals when in closed position, and wherein said actuating means causes said actuating shaft to execute substantially 45 degrees of rotary motion for operating said valve blade between maximally open position and closed position, and in which a portion of said walled passage's axis that extends axially coextensive with and immediately contiguous said groove both toward said inlet and toward said outlet comprises an offset that causes respective segments of said walled passage's axis that are respectively toward said inlet and toward said outlet relative to said groove to be non-colinear, and said sealing ring is disposed substantially at an acute angle to said respective segments of said walled passage's axis.

7. An EGR valve as set forth in claim 6 in which said actuating means comprises a rotary torque motor disposed exterior of said walled passage, and said actuating shaft extends from said rotary torque motor into said walled passage.

8. An EGR valve as set forth in claim 7 in which said actuating shaft has an axis that substantially intersects and is disposed at about 70 degrees to one of said respective segments of said walled passage's axis.

9. An exhaust gas recirculation (EGR) valve for an internal combustion engine comprising a body, an inlet at which engine exhaust gas to be recirculated enters said body, a walled passage that has its own axis and that extends through said body for conveying engine exhaust gas that has entered said inlet, an outlet at which engine exhaust gas that has passed through said walled passage exits said body, a valve blade that is disposed within said walled passage and is selectively positionable within said walled passage for selectively restricting flow through said walled passage, actuating means, an actuating shaft operatively coupling said actuating means with said valve blade for selectively positioning said valve blade by means of said actuating means between a maximally open position wherein said valve blade minimally restricts said walled passage and a closed position wherein said valve blade is sealed relative to said walled passage, sealing means for sealing said valve blade relative to said walled passage when said valve blade is in closed position comprising a sealing ring mounted on, and extending peripherally around, said walled passage, said sealing ring having an inside perimeter against which an outside perimeter of said valve blade seals when in closed position, and wherein said actuating means causes said actuating shaft to execute substantially 45 degrees of rotary motion for operating said valve blade between maximally open position and closed position, said valve body comprises respective axially extending body segments disposed axially end-to-end and cooperatively defining a radially inwardly open groove within which said sealing ring is disposed, said groove comprising opposed axially facing wall surfaces, and including means providing for said sealing ring to position itself within said groove during the process of assembling the EGR valve comprising respective individual elements associated with said groove, each respective individual element being disposed between a respective one of said axially facing wall surfaces and a respective axially facing end surface of said sealing ring, and including a further sealing means disposed radially outwardly of said groove for sealing between said body segments so that engine exhaust gas does not leak out of said walled passage between said body segments.

10. An EGR valve as set forth in claim 9 in which said body segments are aluminum or an aluminum alloy and said elements are stainless steel.

11. An exhaust gas recirculation (EGR) valve for an internal combustion engine comprising a body, an inlet at which engine exhaust gas to be recirculated enters said body, a walled passage that has its own axis and that extends through said body for conveying engine exhaust gas that has entered said inlet, an outlet at which engine exhaust gas that has passed through said walled passage exits said body, a valve blade that is disposed within said walled passage and is selectively positionable within said walled passage for selectively restricting flow through said walled passage, said valve blade comprising a perimeter that is substantially co-planar, actuating means comprising a rotary torque motor and an actuating shaft that operatively couples said actuating means with said valve blade for selectively positioning said valve blade by means of said rotary torque motor between a minimally restrictive position wherein said valve blade minimally restricts said walled passage and a maximally restrictive position wherein said valve blade maximally restricts said walled passage, and wherein said actuating shaft is affixed to a region of said valve blade that is bounded by said valve blade's perimeter and is disposed at an acute angle to the plane of said valve blade's perimeter, and in which said actuating shaft executes substantially about 45 degrees of rotation about its own axis to operate said valve blade between the minimally restrictive position and the maximally restrictive position.

12. An EGR valve as set forth in claim 11 in which said acute angle is substantially about 20 degrees.

13. An EGR valve as set forth in claim 11 including sealing means for sealing said valve blade relative to said walled passage when said valve blade is in maximally restrictive position to close said walled passage to engine exhaust gas flow, said sealing means comprising a sealing ring mounted on, and extending peripherally around, said walled passage and being disposed for engagement by said perimeter of said valve blade.

14. An exhaust gas recirculation (EGR) valve for an internal combustion engine comprising:

a body;

a walled passage extending through said body, and defining an axis, for conveyance of exhaust gas therethrough, wherein a portion of said walled passage's axis comprises an offset that causes respective segments of said walled passage's axis that extend from respective opposite ends of said offset to be non-colinear;

a valve blade which is disposed within said walled passage, and which is selectively positionable therein for selectively restricting exhaust gas flow through said walled passage;

an actuating shaft coupled to said valve blade and oriented at an acute angle relative to the axis; and a rotary torque motor operatively coupled to said actuating shaft, for positioning said valve blade between a closed position wherein said blade obturates that portion of said walled passage's axis that comprises an offset and a maxially open position wherein an outer perimeter of said blade occupies a plane that is substantially parallel with said respective segments of said walled passage's axis that extend from said respective opposite ends of said offset.

15. An EGR valve as set forth in claim 14 including sealing means for sealing said valve blade relative to that portion of said walled passage's axis that comprises an offset when said valve blade is in closed position, said sealing means comprising a sealing ring mounted on, and extending peripherally around, that portion of said walled passage's axis that comprises an offset and being disposed for engagement by said outer perimeter of said valve blade.

16. An exhaust gas recirculation (EGR) valve for an internal combustion engine comprising a body, an inlet at which engine exhaust gas to be recirculated enters said body, a walled passage that has its own axis and that extends through said body for conveying engine exhaust gas that has entered said inlet, an outlet at which engine exhaust gas that has passed through said walled passage exits said body, a valve blade that is disposed within said walled passage and is selectively positionable within said walled passage for selectively restricting flow through said walled passage, actuating means disposed exterior of said walled passage, an actuating shaft operatively coupling said actuating means with said valve blade for selectively positioning said valve blade between a closed position wherein said valve blade is sealed relative to said walled passage and a number of increasingly open positions, and a sealing ring mounted on, and extending peripherally around, said walled passage, said sealing ring having its own axis and comprising opposite end surfaces facing in opposite axial directions relative to said sealing ring's axis and a radially inward surface extending between said opposite end surfaces, said valve body comprising respective body segments disposed end-to-end axially along said walled passage's axis and cooperatively defining a groove that is radially inwardly open relative to said walled passage's axis and within which said sealing ring is disposed, and means providing for said sealing ring to position itself within said groove during the process of assembling the EGR valve such that said radially inward surface of said sealing ring concentrically seals to an outer perimeter of said valve blade when said valve blade is in closed position, said groove comprising confronting wall surfaces that are axially spaced apart along said walled passage's axis, and said means providing for said sealing ring to position itself within said groove during the process of assembling the EGR valve including a separate individual element in association with said groove and disposed between one of said confronting wall surfaces of said groove and one end surface of said sealing ring, said separate individual element comprising a resilient portion for resiliently urging said sealing ring away from said respective one of said confronting wall surfaces of said groove, and including a sealing means disposed radially outwardly of said groove relative to said walled passage's axis for sealing between said body segments so that engine exhaust gas does not leak out of said walled passage between said body segments.

17. An exhaust gas recirculation (EGR) valve as set forth in claim 16 including a further separate individual element in association with said groove and disposed between another of said confronting wall surfaces of said groove and another of said opposite end surfaces of said sealing ring, said resilient portion of said firstmentioned separate element resiliently urging said sealing ring against said further separate individual element.

* * * * *